US006663221B2

(12) United States Patent
Anagnostopoulos et al.

(10) Patent No.: US 6,663,221 B2
(45) Date of Patent: Dec. 16, 2003

(54) PAGE WIDE INK JET PRINTING

(75) Inventors: Constantine N. Anagnostopoulos, Mendon, NY (US); Charles F. Faisst, Avon, NY (US); John A. Lebens, Rush, NY (US)

(73) Assignee: Eastman Kodak Company, Rochester, NY (US)

( * ) Notice: Subject to any disclaimer, the term of this patent is extended or adjusted under 35 U.S.C. 154(b) by 81 days.

(21) Appl. No.: 09/731,355

(22) Filed: Dec. 6, 2000

(65) Prior Publication Data

US 2002/0067391 A1 Jun. 6, 2002

(51) Int. Cl.[7] ..... B41J 2/15
(52) U.S. Cl. ..... 347/40; 347/47; 347/74
(58) Field of Search ..... 347/12, 40, 15, 347/43, 73, 74, 47, 59, 65, 57, 54

(56) References Cited

U.S. PATENT DOCUMENTS

| | | | | |
|---|---|---|---|---|
| 3,946,398 A | | 3/1976 | Kyser et al. | |
| 4,346,387 A | | 8/1982 | Hertz | |
| 5,581,284 A | * | 12/1996 | Hermanson | 347/43 |
| 5,726,693 A | | 3/1998 | Sharma et al. | |
| 5,739,831 A | | 4/1998 | Nakamura | |
| 5,825,385 A | | 10/1998 | Silverbrook | |
| 5,850,241 A | | 12/1998 | Silverbrook | |
| 5,880,759 A | | 3/1999 | Silverbrook | |
| 6,019,457 A | | 2/2000 | Silverbrook | |
| 6,079,821 A | | 6/2000 | Chwalek et al. | |
| 6,126,270 A | | 10/2000 | Lebens et al. | |
| 6,132,032 A | | 10/2000 | Bryant et al. | |
| 6,217,156 B1 | * | 4/2001 | Hawkins et al. | 347/56 |
| 6,258,286 B1 | * | 7/2001 | Hawkins et al. | 347/47 |

FOREIGN PATENT DOCUMENTS

| | | |
|---|---|---|
| EP | 0 911 168 A2 | 4/1999 |
| EP | 0911 168 A3 | 12/1999 |
| GB | 2007162 | 5/1979 |

OTHER PUBLICATIONS

"Poly–Si TFT Driver Circuits for a–Si TFT–AMLCDs", by A. Lewis et al, SID 94 Digest, 1994, pp 251–253.

"11.8 and 10.4 Inch Diagonal Color TFT–LCDs with XGA Compatibility" by Sakurai et al, SID 93 Digest, 1993, pp. 463–466.

"A Six Mask TFT–LCD Process Using Copper–Gate Metallurgy" by P.M. Fryer et al., SID 96 Digest, 1996, pp. 333–336.

"A 2.4–in. Driver–Integrated Full–Color Quarter VGA (320×3×240) Poly–Si TFT LCD by a Novel Low Temperature Process Using a Combination of ELA and RTA Technology," by Y. Morimoto et al, Sanyo Electric Co. Ltd., IEEE–IEDM Tech. Dig., 1995, pp. 837–840.

* cited by examiner

*Primary Examiner*—Lamson Nguyen
(74) *Attorney, Agent, or Firm*—Norman Rushefsky

(57) ABSTRACT

Methods are disclosed for fabricating page wide Drop-on-Demand and continuous ink printheads in which the nozzle array, the heaters, their drivers and data carrying circuits are all integrated on the same non-silicon and non-semiconducting substrate.

37 Claims, 8 Drawing Sheets

PAGE WIDE INK JET PRINTING

FIELD OF THE INVENTION

This invention generally relates to the field of digitally controlled printing devices, and in particular to liquid ink printheads which integrate multiple nozzles on a single substrate and in which a liquid drop is selected for printing by thermo-mechanical means.

BACKGROUND OF THE INVENTION

Ink jet printing has become recognized as a prominent contender in the digitally controlled, electronic printing arena because, e.g., of its non-impact, low noise characteristics and system simplicity. For these reasons, ink jet printers have achieved commercial success for home and office use and other areas.

Ink jet printing mechanisms can be categorized as either continuous (CIJ) or Drop-on-Demand (DOD). U.S. Pat. No. 3,946,398, which issued to Kyser et al. in 1970, discloses a DOD ink jet printer which applies a high voltage to a piezoelectric crystal, causing the crystal to bend, applying pressure on an ink reservoir and jetting drops on demand. Piezoelectric DOD printers have achieved commercial success at image resolutions greater than 720 dpi for home and office printers. However, piezoelectric printing mechanisms usually require complex high voltage drive circuitry and bulky piezoelectric crystal arrays, which are disadvantageous in regard to number of nozzles per unit length of printhead, as well as the length of the printhead. Typically, piezoelectric printheads contain at most a few hundred nozzles.

Great Britain Patent No. 2,007,162, which issued to Endo et al., in 1979, discloses an electrothermal drop-on-demand ink jet printer that applies a power pulse to a heater which is in thermal contact with water based ink in a nozzle. A small quantity of ink rapidly evaporates, forming a bubble, which causes a drop of ink to be ejected from small apertures along an edge of a heater substrate. This technology is known as thermal ink jet or bubble jet.

Thermal ink jet printing typically requires that the heater generates an energy impulse enough to heat the ink to a temperature near 400° C. which causes a rapid formation of a bubble. The high temperatures needed with this device necessitate the use of special inks, complicates driver electronics, and precipitates deterioration of heater elements through cavitation and kogation. Kogation is the accumulation of ink combustion by-products that encrust the heater with debris. Such encrusted debris interferes with the thermal efficiency of the heater and thus shorten the operational life of the printhead. And, the high active power consumption of each heater prevents the manufacture of low cost, high speed and page wide printheads.

U.S. Pat. No. 4,346,387, entitled METHOD AND APPARATUS FOR CONTROLLING THE ELECTRIC CHARGE ON DROPLETS AND INK JET RECORDER INCORPORATING THE SAME, issued in the name of Carl H. Hertz on Aug. 24, 1982, discloses a CIJ system. Such a system requires that the droplets produced be charged and then deflected into a gutter or onto the printing medium. The charging and deflection mechanisms are bulky and severely limit the number of nozzles per printhead.

U.S. Pat. No. 5,739,831, entitled ELECTRIC FIELD DRIVEN INK JET PRINTER HAVING A RESILIENT PLATE DEFORMED BY AN ELECTROSTATIC ATTRACTION FORCE BETWEEN SPACED APART ELECTRODES, issued to Haruo Nakamura on Apr. 14, 1998, discloses an electric field drive type printhead that applies an external laser light through a transparent glass substrate. The laser light strikes a photo conductive material causing it to become conductive thus completing the electrical path for the electrical field. Completion of the electrical path causes the electrical field to collapse around individual segments. These segments are in a deformed state due to their electromechanical response to the applied electric field. The individual segments in contact with a body of ink relax causing a volume of ink to issue from a nozzle plate. This type of printhead requires very high voltages to create the electric field. It also requires very complex laser and mirror systems to control the electric field. These factors prevent the manufacture of low cost, high speed, page wide printheads.

U.S. Pat. No. 5,880,759 entitled LIQUID INK PRINTING APPARATUS AND SYSTEM, issued in the name of Kia Silverbrook on Mar. 19, 1999 and Commonly assigned U.S. patent application Ser. No. 08/954,317 entitled CONTINUOUS INK JET PRINTER WITH ASYMMETRIC HEATING DROP DEFLECTION filed in the names of James Chwalek, Dave Jeanmaire and Constantine Anagnostopoulos on Oct. 17, 1997 and now issued as U.S. Pat. No. 6,079,821, on the other hand, disclose liquid printing systems that afford significant improvements toward overcoming the prior art problems associated with the number of nozzles per printhead, printhead length, power usage and characteristics of useful inks. However, these systems disclose printheads that are fabricated using VLSI silicon technology. Because of the circular geometry of the silicon wafers and limit on their maximum diameter, currently 12" for state of the art facilities, there is a limit on the maximum length monolithic printheads can be fabricated and manufactured economically.

Each of the described ink jet printing systems has its advantages and disadvantages. However, there remains a widely recognized need for an improved ink jet printing system, providing advantages for example, as to cost, size, speed, quality, reliability, small nozzle orifice size, small droplet size, low power usage, simplicity of construction and operation, durability, and manufacturability. In this latter regard, there is a particular long standing need for the capability to manufacture page wide, high resolution ink jet printheads on a single substrate to overcome the current size limitations associated with silicon wafers. As used herein, the term "page wide" refers to printheads of a minimum length of about 4" and maximum length of about 17". High resolution implies nozzle density, for each ink color, of a minimum of around 300 nozzles per inch to a maximum of around 2400 nozzles per inch.

In an unrelated field to ink jet print systems are liquid crystal displays (LCD). LCDs are the dominant flat panel display technology for use in laptop computers, hand-held games, and personal digital assistants (PDAs). LCD displays are constructed using thin film transistor (TFT) technologies. Thin film transistors are typically constructed on glass substrates. Typical sizes for glass substrates vary from 0.5" per side up to, but not limited to, 15" per side. There are different methods for constructing thin film transistors on glass substrates. Reference for instance, the article by A. Lewis, V. Da Costa, R. Martin, "Poly-Si TFT Driver Circuits for a-Si TFT-AMLCDs, SID 94 Digest, 1994, pp 251–253, which discloses construction of a 13 inch diagonal LCD using poly-silicon TFTs. Reference also T. Sakurai, K. Kawai, Y. Katoaka, N. Kondo, K. Hashimoto, M. Katayama, T. Nagayasu, Y. Nakata, S. Mizushima, K. Yano, "11.8 and 10.4 inch diagonal Color TFT-LCDs with XGA Compatibility, "SID 93 Digest, 1993, pp. 463–466, wherein 10.4 inch and 11.8 inch diagonal color LCDs were fabricated using amorphous silicon (a-Si) TFT technology. Still further, reference P.M. Fryer, et al., "A Six Mask TFT-LCD Process Using Copper-Gate Metallurgy," SID 96 Digest, 1996, pp. 333–336, wherein fabrication of a 10.5 inch diagonal display using amorphous based thin film transistor technology is disclosed. Finally, reference Y. Morimoto et al, of Sanyo Electric Co. LTD., "A 2.4-in Driver-Integrated Full-Color Quarter VGA (320X3X240) Poly-Si TFT LCD by a Novel Low Temperature Process Using a Combination of ELA and RTA technology," IEEE-IEDM Tech. Dig., 1995, pp. 837–840.

All of the above-referenced articles use different processes to form TFTs in order to create control circuitry on a glass substrate. These circuits include, but are not limited to, shift registers, drivers, and logic gates. These examples show that large (about 4 inches or greater) substrates are suitable for constructing digital control circuitry.

Thus, what is required is the capability for the formation of an ink jet printhead using a non-silicon substrate having a large width dimension so as to overcome the problem of size limitations of previous printhead constructions utilizing silicon wafer substrates.

SUMMARY OF THE INVENTION

An advantage of the present invention is the improved fabrication of page wide ink jet printheads, of the type for example described by Silverbrook in U.S. Pat. No. 5,880,759 or Chwalek et al, in U.S. Pat. No. 6,079,821, but using substrates other than semiconductive silicon wafer substrates to solve the problem of printhead width limitations.

The present invention therefore principally resides in, among other features, the provision of a particular ink jet printhead design comprising, inter alia, a substrate of a material selected from the group consisting of glass, metal, ceramic or plastic, the substrate having a front surface and at least partially defining an ink holding chamber. The printhead also includes a nozzle plate structure disposed on the front surface of the substrate, the nozzle plate structure being composed of any number of layers of conducting, semi-, and non-conducting material and defining a plurality of ink ejecting orifices therethrough communicating with the ink holding chamber. The nozzle plate structure additionally includes a corresponding actuating element for each ink ejecting orifice. The actuating element is preferably a heater, controllably operable for causing, in DOD type devices, a quantity of ink held in the ink holding chamber to be ejected through the ink ejecting orifice. In CIJ devices, the heaters serve to break up the jet stream of ink into a synchronous array of droplets and to deflect the ink stream.

In one preferred aspect of the invention, the printhead additionally includes a mechanical actuator or actuators controllably operable for exciting or oscillating the ink in the holding chamber to lift the ink to the heaters for facilitating ejection.

A feature of the present invention is the provision of a substrate of a metal, such as stainless steel, or of ceramic or of glass, or resinous material such as polyimide which is larger in surface extent than currently used silicon wafers, such that the printhead can have a continuous extent or width of as much as 17" or larger, if it is needed.

Another feature of the present invention is the provision of actuating elements for the heaters operatively controlled by drive circuitry using TFT (Thin Film Transistor) technology or silicon based ASICs (Application Specific Integrated Circuits).

Yet another feature of the present invention is the provision of a nozzle plate made of flexible material to prevent cracking, due to stress, of the long printheads or to enable them to be fitted onto curved surfaces.

These and other objects, features and advantages of the present invention will become apparent to those skilled in the art upon reading of the following detailed description when taken in conjunction with the drawings wherein there are shown and described illustrative embodiments of the invention.

BRIEF DESCRIPTION OF THE DRAWINGS

While the specification concludes with claims particularly pointing out and distinctly claiming the subject matter of the present invention, it is believed the invention will be better understood from the following detailed description when taken in conjunction with the accompanying drawings.

DETAILED DESCRIPTION

This description will be directed in particular to elements forming part of, or cooperating more directly with, apparatus in accordance with the present invention. It is to be understood that elements not specifically shown or described may take various forms well known to those skilled in the art.

Figure 1:
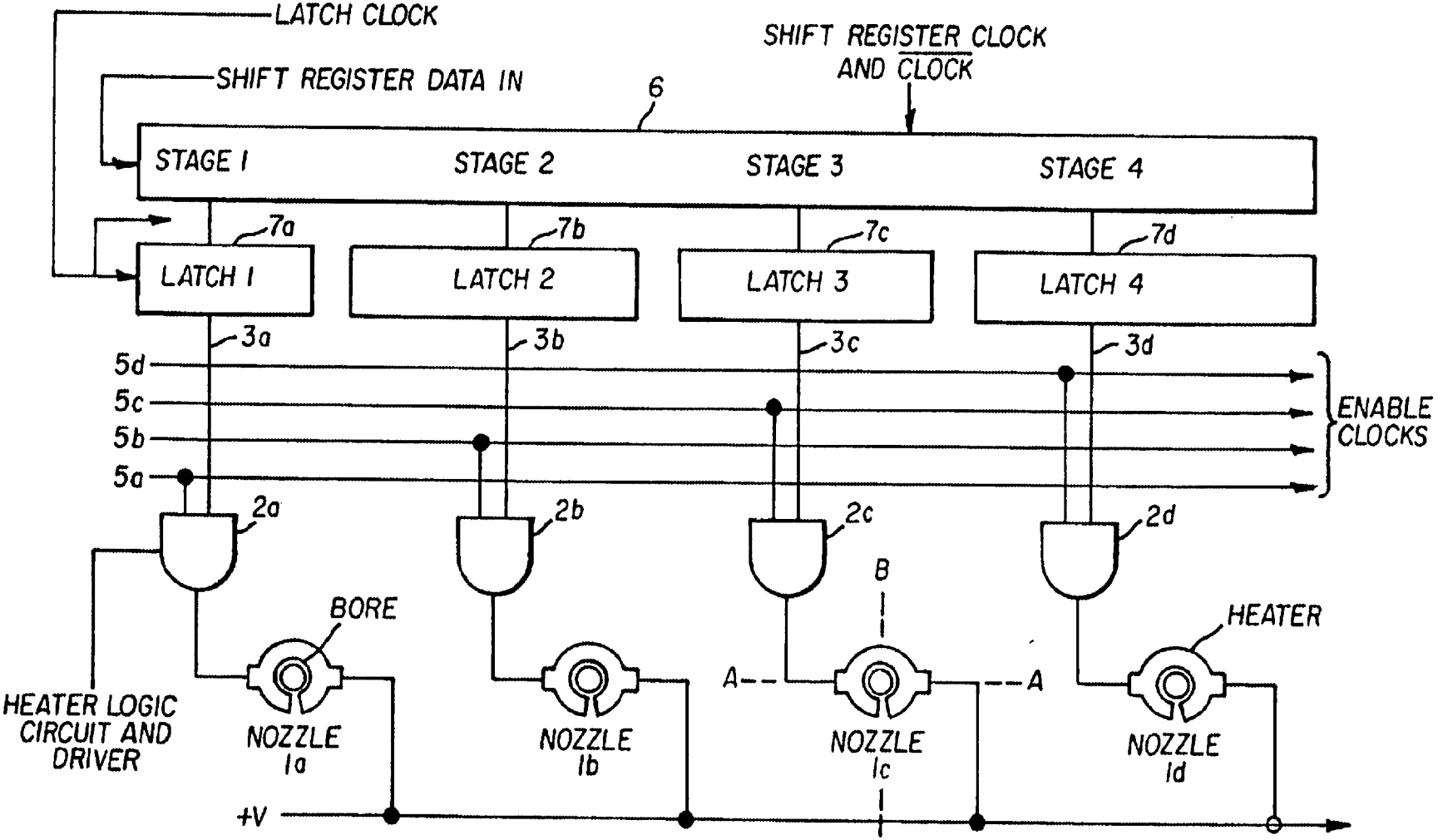
FIG. 1 is a schematic and fragmentary top view of a printhead constructed in accordance with the present invention.

Therefore, referring to FIG. 1, there is shown a top view of an ink jet printhead according to the teachings of the present invention. The printhead comprises an array of nozzles 1*a*–1*d* arranged in a line or a staggered configuration. Each nozzle is addressed by a logic AND gate (2*a*–2*d*) which each contain logic circuitry and a heater driver transistor (not shown). The logic circuitry causes a respective driver transistor to turn on if a respective signal on a respective data input line (3*a*–3*d*) to the AND gate (2*a*–2*d*) and the respective enable clock lines (5*a*–5*d*), which is connected to the logic gate, are both logic ONE. Furthermore, signals on the enable clock lines (5*a*–5*d*) determine durations of the lengths of time current flows through the heaters in the particular nozzles 1*a*–1*d*. Data for driving the heater driver transistor may be provided from processed image data that is input to a data shift register 6. The latch register 7*a*–7*d*, in response to a latch clock, receives the data from a respective shift register stage and provides a signal on the lines 3*a*–3*d* representative of the respective latched signal (logical ONE or ZERO) representing either that a dot is to be printed by ejecting a spot of the ink or not printed by not ejecting or causing any ejected ink to be deflected to a location other than the receiver. In the third nozzle, the lines A—A and B—B define the direction in which cross-sectional views are taken at FIGS. 4A, 5, 6 and 7.

Figure 2:
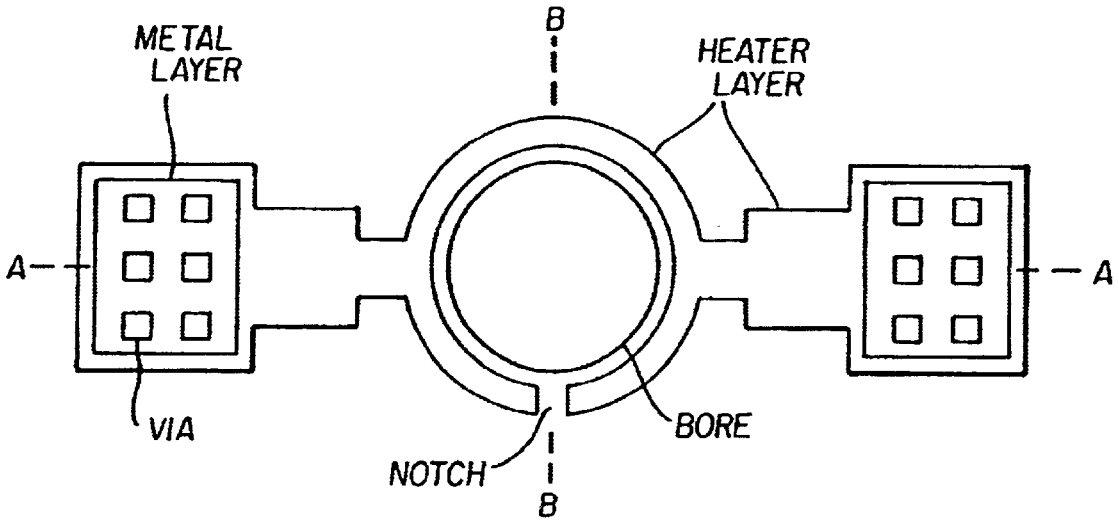
FIG. 2 is a simplified top view of a nozzle with a "notch" type heater for a CIJ printhead in accordance with the invention.
Figure 3:
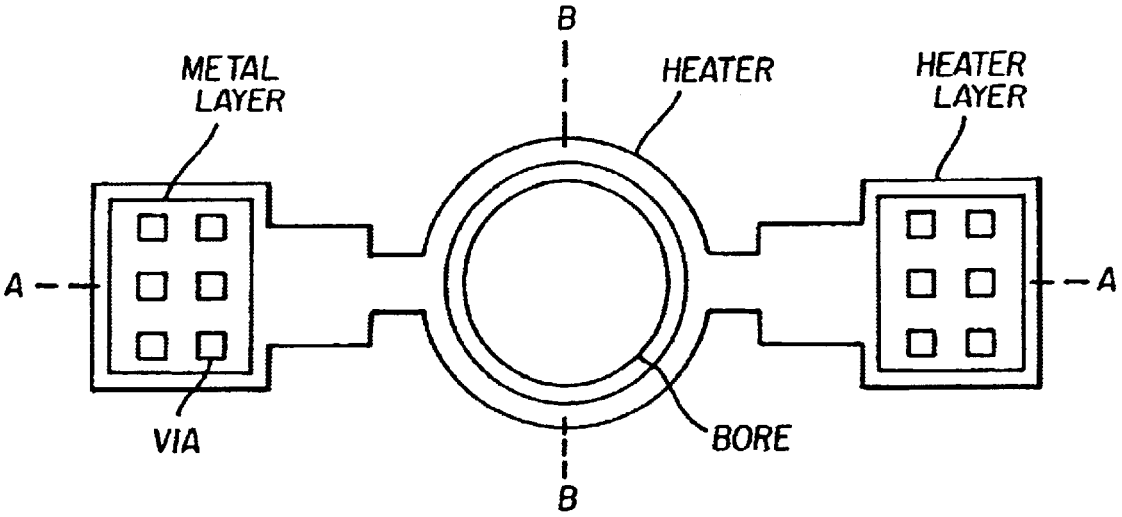
FIG. 3 is a simplified top view of a nozzle with a "full" type heater for a DOD LIFT type printhead in accordance with the invention.
Figure 4:
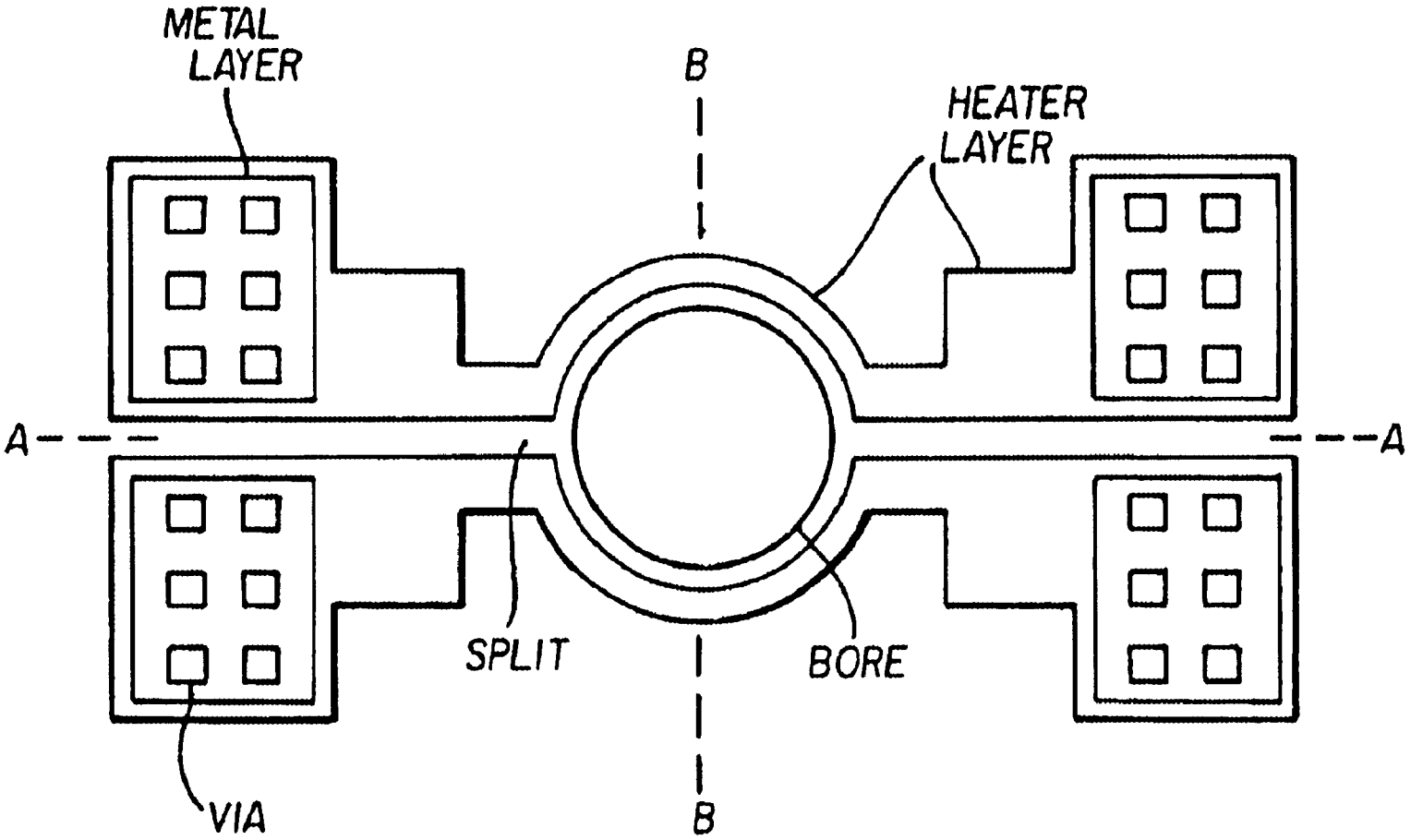
FIG. 4 is a simplified top view of a nozzle with a "split" type heater for a CIJ printhead in accordance with the invention.
Figure 4A:
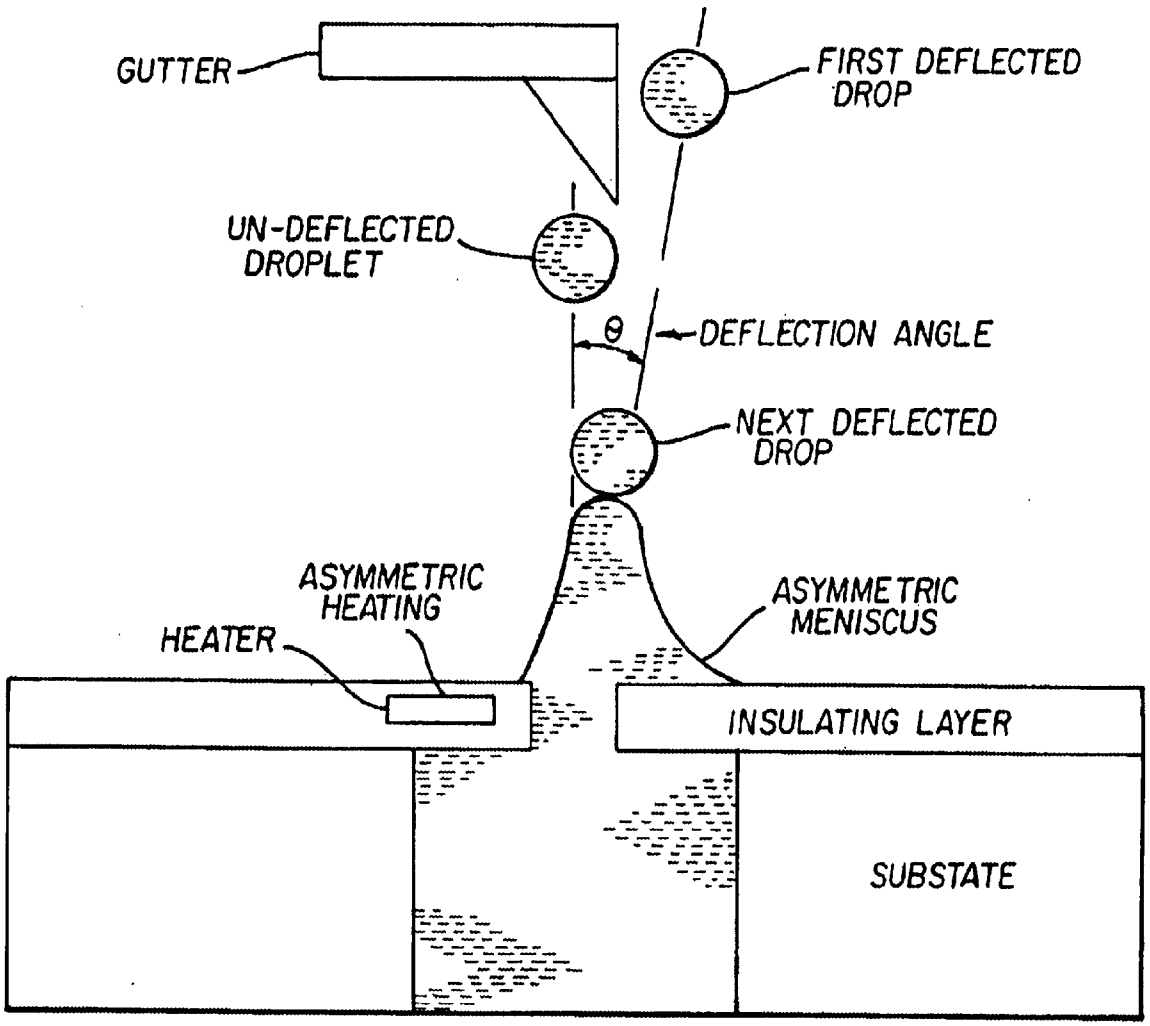
FIG. 4A is cross-sectional view of the nozzle along line B—B of FIG. 5.

FIGS. 2 and 4 show those cross-sectional views in the two types of heaters (the "notch type" and "split type" respectively) used in CIJ printheads. They produce asymmetric heating of the jet and thus cause ink jet deflection. FIG. 3 shows the heater configuration for a LIFT type DOD printhead. LIFT type printheads are described in U.S. Pat. No. 5,880,759.

Figure 5:
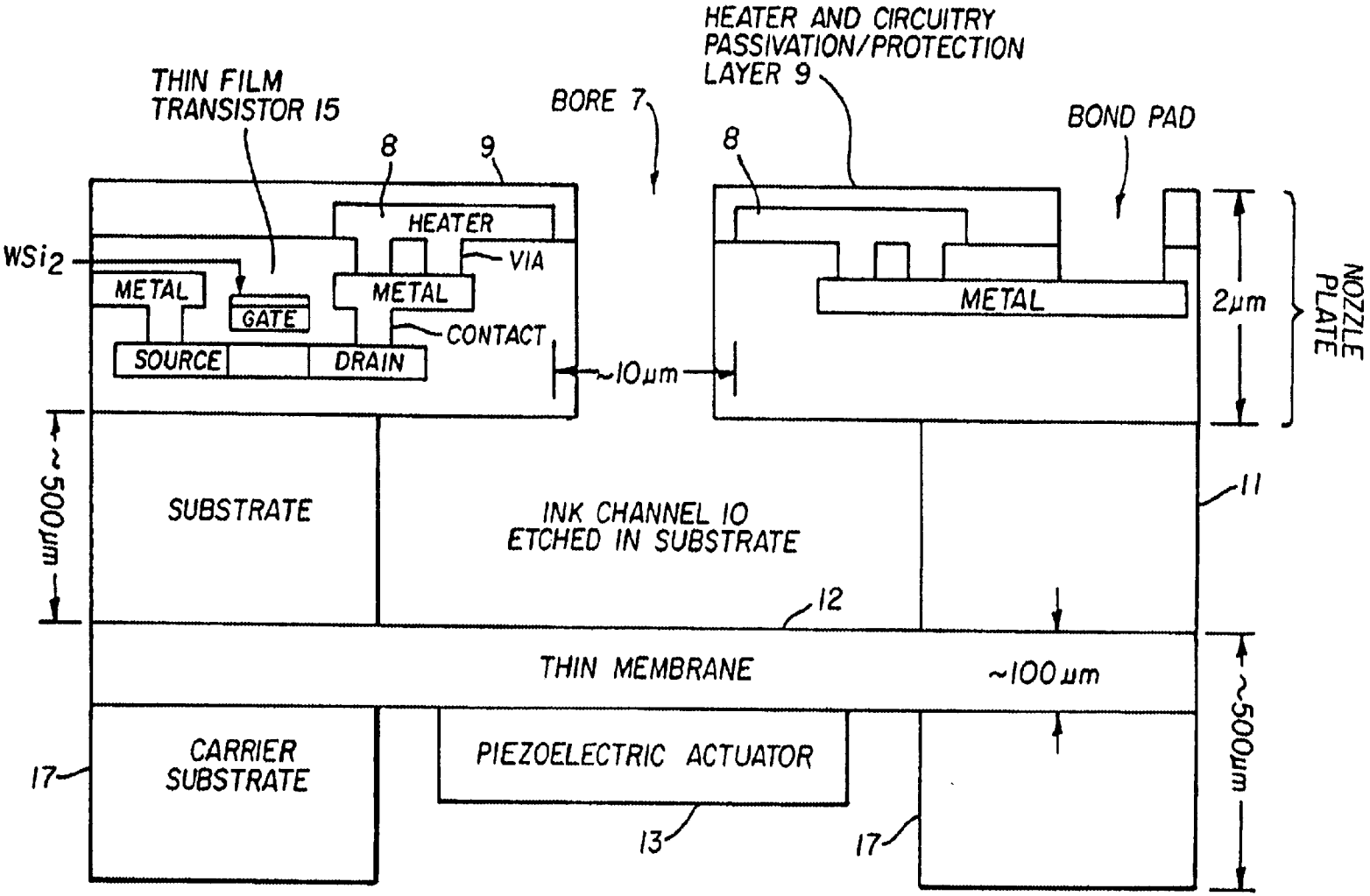
FIG. 5 is a simplified schematic sectional representation of a DOD type printhead taken along line A—A of FIG. 3 through an exemplary ink ejecting orifice and TFT of the printhead.
Figure 6:
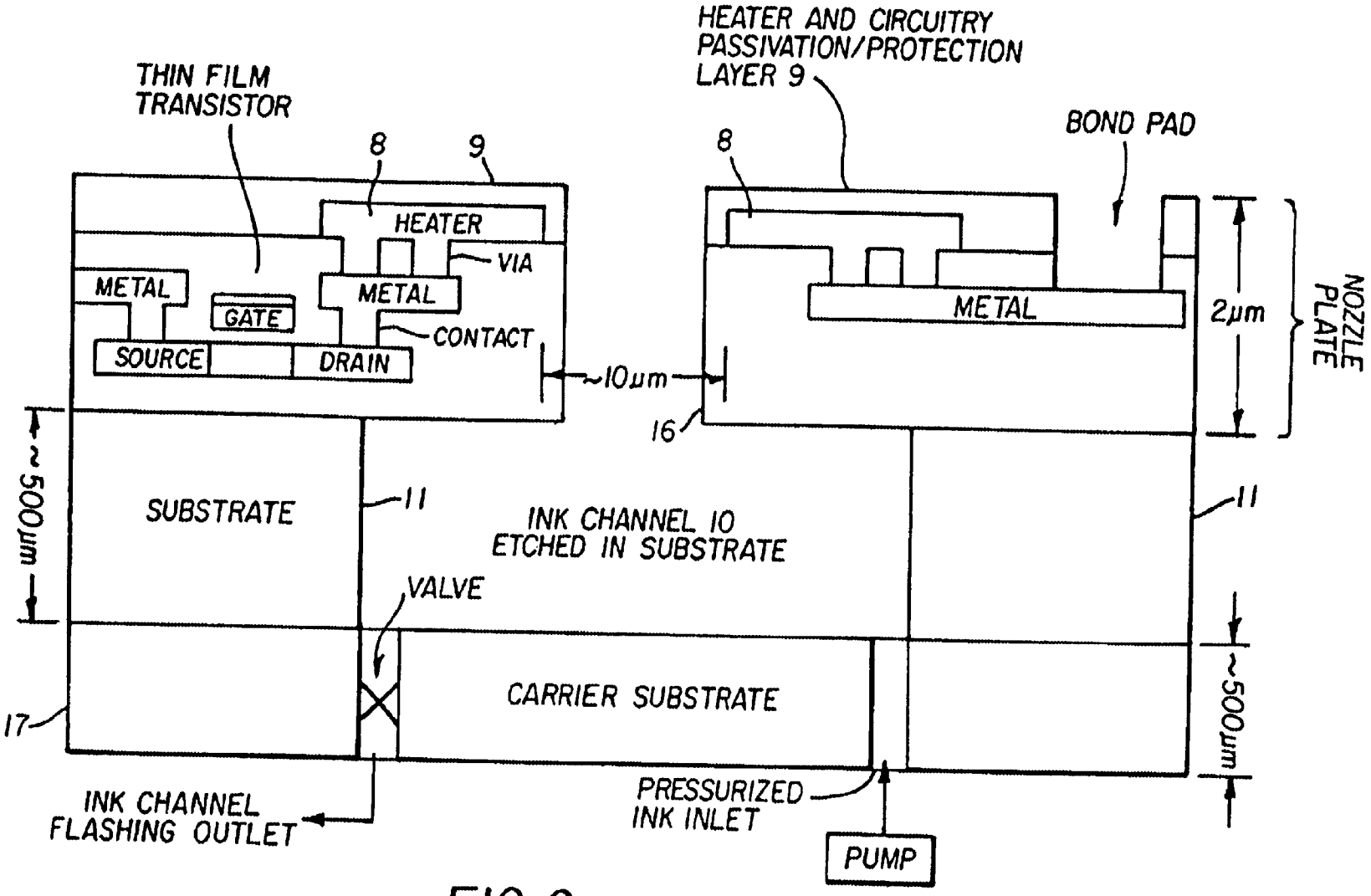
FIG. 6 is a simplified schematic sectional representation of a CIJ type printhead taken along line A—A of FIG. 2 through an exemplary ink ejecting orifice and TFT of the printhead.

At FIGS. 5 and 6, Thin Film Transistors (TFTs) 15 fabricated from any of many technologies onto glass substrates may be employed to build the printheads. Following the fabrication sequence of, for example, the previously described Morimoto reference thin film transistor circuits are formed within a semiconductor layer (such as poly silicon or amorphous silicon) formed on the glass layer. In this fabrication process multiple layers are formed of conductive material that are connected by vias so that current from a thin film transistor is connected to a heater 8 located adjacent to an ink ejecting bore 7. Openings for bond pads may also be provided in the surface to allow connections to be made to metal layers. The process employs the known thin film technology but adds one additional mask to define and etch the nozzle bore 10*a*, and results in a nozzle plate with the circuitry shown schematically in FIG. 5. Also, the well known ITO film used in LCD devices discussed by Morimoto et al, can be used as the heater layer 8 as can other low temperature deposition films made from for example, TiN, TiAl and the like. To protect heater 8 from the corrosive properties of the inks, and from mechanical abrasion that may result from the periodic cleaning of the printhead, a passivation and protection layer 9 consisting of one or more thin films is deposited on top of the heater prior to the bore etching step. This layer 9 may be, for example, made from PECVD, $Si_3N_4$, or other inert and high abrasion resistant films. To complete the device shown in FIG. 5, an ink channel 10 is photolithographically imaged, using photoresist, in the backside surface of the substrate 11 and then dry etched completely through the substrate 11. When substrate 11 is glass, the ink channel 10 can be etched with plasma containing any of the many well known active plasma etch species. The ink channel 10 is aligned with contiguous structures in the front of the substrate 11 with the aid of front to back alignment targets. The substrate 11 may be rigid such as glass, metal or ceramic or may be flexible such as described below. For DOD LIFT type printheads as in FIG. 3, a thin flexible membrane 12 is attached to the back of the substrate 11, or formed as part of carrier substrate 17, and to that membrane 12 is attached a piezoelectric transducer 13. The transducer 13 may be sufficiently long to service all the nozzles 16 at once, or each nozzle may have its own transducer. In operation, for a droplet to be ejected from a given nozzle, both the piezoelectric transducer 13 and the heater 8 are excited simultaneously or within a short period relative to each other.

For a CIJ printhead, as shown in FIG. 6, where parts corresponding to that of FIG. 5 are given a similar number, there is no need for a piezoelectric element in the back of the nozzles. Instead, the ink supply in each of the ink channels 10 is under sufficient pressure to continuously eject ink jets from each nozzle 16. Asymmetric heating is applied to the ink jets, as they emanate from the nozzle, to cause jet deflection and droplet formation. A heater is inside each nozzle to actuate the ink, but a second actuating element is also needed, i.e. a pump (not shown) is present to effect the pressure needed in the ink recirculation line to cause the ink to eject from the nozzles.

The substrate 11 may be rigid, such as glass, metal or ceramic, or it may be more flexible such as thermoplastic material, e.g., organic polymers like polyimide. In the latter case, the flexible substrate may be originally glued to a more rigid support for the purpose of accurate lithography and ease of handling. The rigid support can then be unglued or dissolved away at the end of the fabrication sequence.

When using TFT technology to build the printheads, in for example FIG. 5, the nozzle plate can crack easily if the printhead is subjected to stress as can happen, for example, during the packaging process or when the printhead experiences differential thermal expansion along its length. This is because the dielectric (non-conducting layers) and semiconducting films or layers forming this plate are extremely rigid. To solve that problem a nozzle plate with more flexible material, such as organic polymer coatings, as for example polyimide may be employed.

Figure 7:
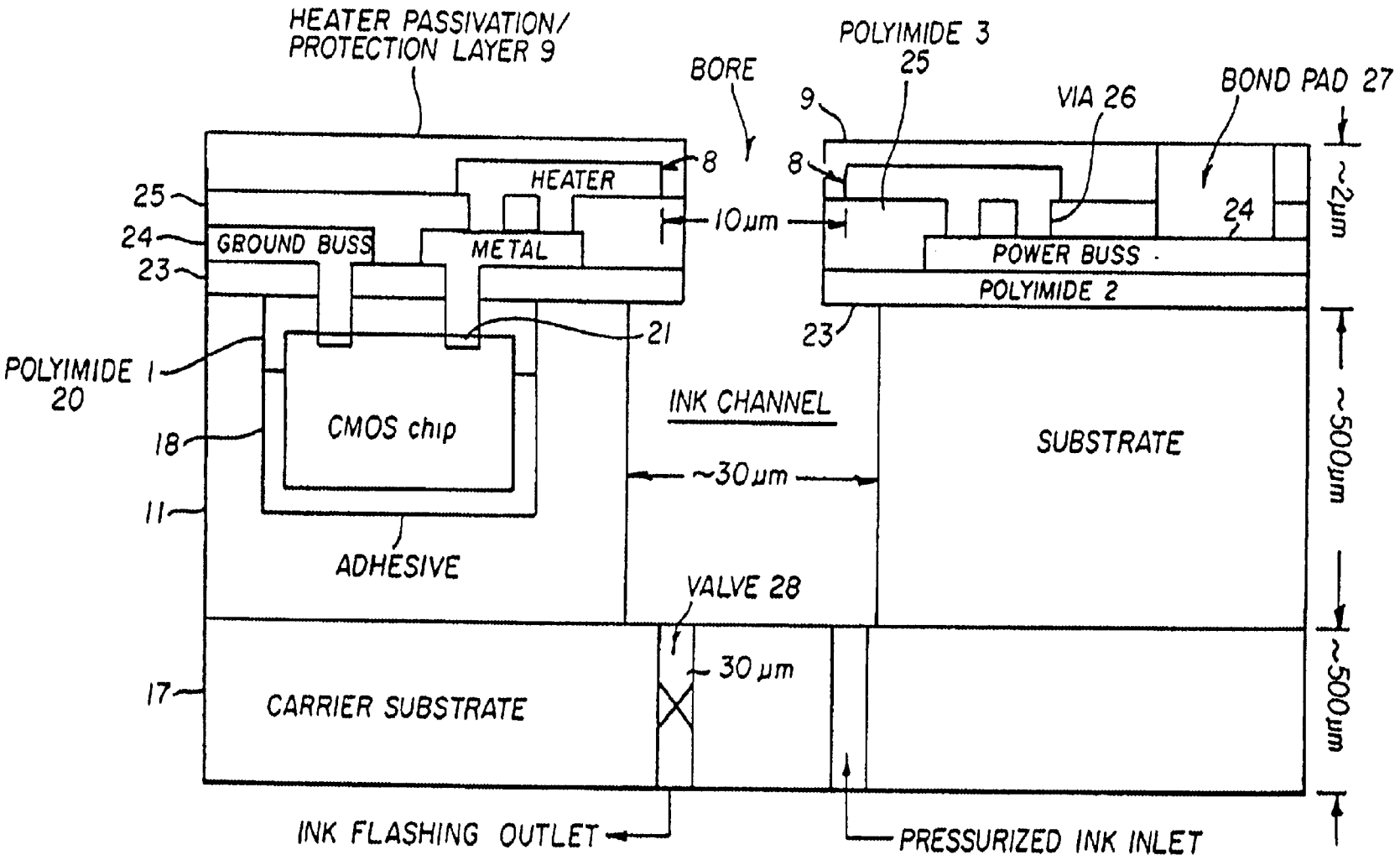
FIG. 7 is a simplified schematic sectional representation of a CIJ hybrid type printhead taken through an exemplary ink ejecting orifice and CMOS chip such as in FIG. 8.
Figure 8:
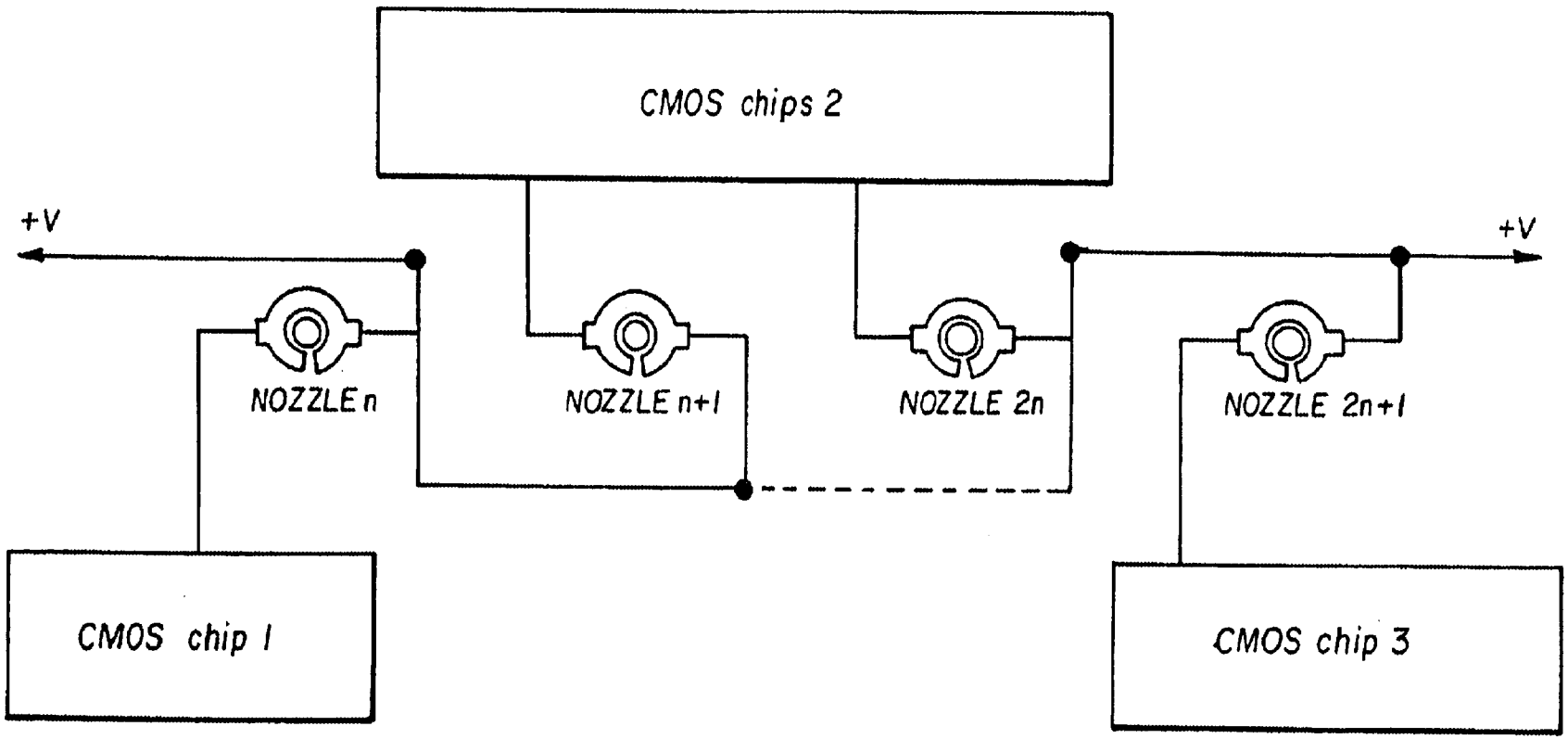
FIG. 8 is a simplified schematic top view of a CIJ hybrid type printhead in accordance with the invention.

However, TFT circuitry 15 for the driver transistors and shift and latch registers often cannot be fabricated on polymers. Instead, as shown in FIGS. 7 and 8, the required circuitry is fabricated with silicon technology on discrete CMOS chips formed in a separate conventional process and effectively potted within openings within the substrate 11 adjacent each ink channel. While this process will be described with reference to the CIJ printhead it is also applicable to the DOD printhead. The thickness of the resulting CMOS chips 18 are thinned from their starting thickness of about 675 $\mu$m (which is the typical but not the only thickness available for 6" wafers) to about 225 $\mu$m or less. CMOS chip width and length may be as large as 2000 $\mu$m wide by 12800 $\mu$m long. The first step in fabricating the printhead with such silicon chips is to etch openings, in the front surface of the substrate 11, which openings are slightly larger than the CMOS chips 18. These openings may be, for example, 2020 $\mu$m wide, by 12820 $\mu$m long by 240 $\mu$m deep. A CMOS ASIC chip 18 is then placed within each respective opening, other types of integrated circuit chips may be used in lieu of ASICs. An adhesive is applied to each opening to secure each chip. The opening is designed so that the top surfaces of the CMOS chips 18 rest at from 1 to 2 $\mu$m below the front surface of the substrate 11. The first photoimageable polyimide layer 20 is then coated to fill the opening and to build up over the substrate 11. Openings are then imaged through the polyimide 20 and etched open for the bond pads 21 which are part of the CMOS chips 18. The polyimide layer 20 is then cured and planarized, on top of the openings over the CMOS chips 18, where the polyimide layer 20 has filled in all the voids and is flush with the surface of the substrate 11. A thin second polyimide layer 23 is then coated over the front surface of the substrate 11 and the polyimide 20 to produce a smooth surface for subsequent lithography. Openings are then imaged and etched in this layer 23 in order to again expose the bond pads 21 of the CMOS chips 18. Aluminum metal film 24 is then deposited over layer 23, defined and etched to form a ground bus, power bus and heater bus as well as to fill in the vias over the bond pads 21 of the CMOS chip. The aluminum metal film also connects the various CMOS chips with clock lines and data lines as indicated in FIG. 1. There is then provided a third coating of a polyimide layer 25. Vias 26 are then defined in layer 25 and etched open. The heater layer 8, which may be fabricated from inorganic compounds such as ITO (indium tin oxide), TiN, or TiAl, or metal such as Molybdenum, Titanium or Tungsten or other material which can be deposited at temperatures below 400° C., is deposited next, imaged (i.e., defined lithographically) and etched. Then a heater passivation and protection layer 9, such as another polyimide layer or $Si_3N_4$ is deposited. Finally, openings for bond pads 27 for the Aluminum metal layer 24 are defined and etched through layers 9 and 25 to complete the processing on the front side of the substrate 11.

As previously discussed, the ink channel 10 is defined and etched from the backsides of the substrate 11 to complete fabrication of the printhead which is then mounted to a carrier substrate 17 that has the required fluidic and electrical interconnections. Important fluidic connections in the carrier substrate are valves 28 that allows flushing of the ink channel prior to attempting to force ink through the nozzles. Such flushing removes debris in the ink channels or tubing which could otherwise clog the nozzles.

The printheads described herein have a surface featuring nozzle openings which surfaces are substantially flat and smooth to facilitate cleaning by blade(s) or a wiper(s) that are moved along the surface.

The method described above when employing ASICS and a flexible nozzle plate technology allows for curved printheads for fitting a curved space, or for flat printheads that are more crack-resistant.

With reference to FIG. 8, there is shown schematically a series of nozzles with different nozzles being addressed or controlled by different CMOS integrated circuit (IC) chips. It is preferred to have a single IC chip address plural nozzles. For example, one IC chip may address 32, 64, 128, or more nozzles depending upon the ability to integrate circuitry into the chips. However, where the ink jet printhead is formed of a flexible substrate and a flexible nozzle plate layer or layers and it is intended to bend the printhead into a curve, it is desirable to adjust the dimensions of the IC chips used to accommodate the bending. Thus, a printhead will have thousands of nozzles arranged preferably in a straight line and plural number of IC chips addressing respective groups of nozzles.

The invention has been described in detail with particular reference to preferred embodiments thereof, but it will be understood that variations and modifications can be effected within the spirit and scope of the invention.

PARTS LIST

1*a*, 1*b*, 1*c*, 1*d* array of nozzles
2*a*–2*d* AND logic circuitry (logic)
3*a*–3*d* data input lines
4*a*–4*d* shift registers
5*a*–5*d* enable clock lines
6*a*–6*d* logic gates
7*a*–7*d* latch registers
8 heater layer (heater)
9 passivation and protection layer
10 ink channel
10*a* nozzle bore
11 substrate
12 thin flexible membrane
13 piezoelectric transducer
15 thin film transister (TFT)
16 nozzle
17 carrier substrate
18 CMOS chips
20 first polyimide layer
21 bond pads on CMOS chips
23 thin second polyimide layer
24 metal film
25 third polyimide layer
26 vias
27 bond pads to metal layer
28 pair of valves in the carrier substrate

What is claimed is:

1. An ink jet print head comprising:

a non-silicon substrate having a front surface and at least partially defining an ink delivery channel, the substrate being of page wide extent wherein said front surface of the substrate has a width of about four inches or greater; and a nozzle array structure disposed on the front surface of the substrate, the nozzle array structure defining at least one ink ejecting bore communicating with the ink delivery channel, the nozzle array structure including a corresponding actuating element for each ink ejecting bore controllably operable for either a DOD ink jet causing a quantity of ink held in the ink delivery channel to be ejected through the ink ejecting bore, or a CIJ serving to break up the jet stream of ink into a synchronous array of drops and to deflect the ink stream, and a drive circuitry selected from the group consisting of TFT devices and discrete integrated circuit chips.

2. The ink jet print head of claim 1, wherein the nozzle array structure comprises a plurality of the ink ejecting bores located at generally uniformly spaced locations along said width.

3. The ink jet print head of claim 1, wherein the printhead is a DOD type wherein the actuating element is a piezoelectric actuating element operable for effecting oscillation or excitation of ink in the ink delivery channel.

4. The ink jet printhead of claim 1, wherein the printhead is a CIJ type and wherein the actuating element comprises a heater, the printhead further comprising a pump to keep the ink under pressure and flowing continuously.

5. The ink jet printhead of claim 1, further comprising a back plate attached to a surface of the substrate opposite the front surface thereof enclosing the ink delivery channel.

6. The ink jet printhead of claim 1, wherein the actuating element comprises a heater.

7. The ink jet printhead of claim 6, wherein the heater is disposed on an outer surface of the nozzle array opposite the substrate.

8. The ink jet printhead of claim 6, wherein the heater is disposed within a non-conducting material layer.

9. The ink jet print head of claim 1, wherein e nozzle array structure is configured from a conducting, a semiconducting or non-conducting material layer which is affixed to the front surface of the substrate.

10. The ink jet print head of claim 9, wherein the material layer is non-conducting and comprises polyimide or other plastic material.

11. The ink jet printhead of claim 1, wherein the substrate comprises stainless steel.

12. The ink jet printhead of claim 1, wherein the substrate comprises glass or ceramic.

13. An ink jet print head comprising; a substrate of a material selected from the group consisting of metal, glass, ceramic and plastic material;

a nozzle array structure disposed on a front surface of said substrate, the nozzle array structure being composed of at least one layer of a semiconducting or non-conducting material;

at least one ink holding chamber defined by the substrate and the nozzle array structure;

a plurality of ink ejecting nozzles extending through the nozzle array structure to the at least one ink delivery channel; and the nozzle array structure including a plurality of actuating elements associated with the plurality of ink ejecting bores, respectively, each of the actuating elements being controllably operable for either DOD ink jet operation causing a quantity of ink in the ink delivery channel to be ejected through an associated ink ejecting bore or a CU operation serving to break up a jet stream of ink into a synchronous array of droplets and to deflect the stream, and a plurality of drive circuits including TFTs or discrete IC chips and conductive paths connecting the TFTs or IC chips to the actuating elements, respectively, wherein said front surface of the substrate has an extent of about four inches or greater.

14. The ink jet printhead of claim 13, wherein the plurality of ink ejecting bores are located at generally uniformly spaced locations along said extent.

15. The ink jet printhead of claim 13, being a CIJ wherein the actuating elements each comprise a heater.

16. The ink jet printhead of claim 13, being a DOD wherein the actuating elements each comprise a piezoelectric device to effect oscillation or excitation of the ink.

17. The ink jet print head of 13, wherein the at least one layer is a non-conducting material that comprises a polyimide.

18. The ink jet printhead of claim 13, wherein the substrate is stainless steel.

19. The ink jet printhead of claim 13, wherein the substrate comprises either ceramic or glass.

20. The ink jet printhead of claim 19, wherein the substrate material is glass.

21. The ink jet print head of claim 13, wherein the ink jet print head is of the continuous ink jet type.

22. The ink jet print head of claim 13, wherein the ink jet print head is of the Drop-on-Demand type.

23. A method of making a page wide ink jet print head structure, the ink jet print head structure being usable in an ink jet printer apparatus of the type selected from the group consisting of continuous ink jet and Drop-on-Demand ink jet printer apparatus, the method comprising:

forming a plurality of nozzles fabricated in a nozzle plate that includes a semiconductor material, the nozzle plate being overcoated over a non-semiconducting substrate having a plurality of ink delivery channels fabricated in and extending within the non-semiconducting substrate, and forming driver components integrated into the nozzle plate for controlling ink jet operation; the forming of the driver components including the steps of fabricating vias and control circuits connected to the vias, the control circuits being formed using thin film transistor technology, wherein the control circuits and vias are integrated into the nozzle plate.

24. The method of claim 23 wherein the substrate and nozzle plate are formed of plastic films to produce a curved print head for fitting a curved space.

25. The method of claim 23 wherein a thin membrane is connected to a surface of said substrate and a piezoelectric actuator is connected to said thin membrane to vibrate same so as to provide a pressure pulse to ink within an ink channel formed in the substrate.

26. An ink jet printhead comprising:

a substrate formed of a non-semiconductor material, the substrate having a plurality of ink channels formed therein;

a nozzle plate over a surface of the substrate, the nozzle plate being formed of a plurality of layers formed using thin film transistor technology to establish transistor current drivers and the nozzle plate having a plurality of nozzle bores formed therethrough and each bore communicating with a respective channel to define a nozzle opening adjacent a first end of the nozzle bore;

a heater element formed proximate the nozzle bore and electrically connected to one of said transistor current drivers;

a passivation layer over the heater element; and the nozzle plate having a plurality of openings therein representing nozzle openings with a nozzle opening being at one end of each nozzle bore, a respective heater element adjacent each nozzle bore and a respective ink channel adjacent an opposite end of each nozzle bore.

27. The ink jet printhead of claim 26 wherein the passivation layer is generally smooth from nozzle opening to nozzle opening along the surface of the passivation layer to facilitate cleaning by a wiper member.

28. An ink jet printhead comprising:

a substrate formed of a non-semiconductor material, the substrate having an ink channel formed therein;

a discrete integrated circuit chip embedded in the surface beneath a first surface of the substrate, the chip including logic circuitry for controlling current for driving a heater element associated with a nozzle bore;

a layer or layers having a nozzle bore formed therethrough, the layer or layers being formed upon the first surface of the substrate, the layer or layers including an electrically conducting buss and a heater element located proximate a nozzle bore formed in the layer or layers, the nozzle bore communicating with the ink channel for permitting flow of ink between the ink channel and the nozzle bore, and the heater element being electrically connected to the chip.

29. The ink jet printhead of claim 28 wherein the substrate includes plural of the ink channels formed therein, the layer or layers having plural of the nozzle bores formed therethrough, each nozzle bore communicates with a respective ink channel and each nozzle bore has a respective heater element located proximate a nozzle bore, plural of the respective heater elements being connected to the chip, there being plural of such chips and the size of the chips and the flexibility of the substrate and the layer or layers being such as to allow the ink jet printhead to be bent into a curved shaped.

30. A method of forming an ink jet printhead comprising:

providing a substrate formed of a non-semiconductor material;

forming a channel in the substrate;

forming an opening in the substrate and depositing a discrete integrated circuit chip into the opening in the substrate;

sealing the chip within the substrate;

establishing vias from the chip to conductive elements formed in one or more layers formed on one surface of the substrate, the one more layers having a nozzle bore formed therein; and establishing a heater element in the one more layers, the heater element being established so as to be proximate the nozzle bore and the heater element being electrically connected to the integrated circuit chip.

31. An ink jet print head comprising:

a non-silicon substrate having a front surface and at least partially defining an ink delivery channel, the substrate being of page wide extent; and a nozzle array structure disposed on the front surface of the substrate, the nozzle array defining at least one ink ejecting bore communicating with the ink delivery channel, the nozzle array including a corresponding actuating element for each ink ejecting bore controllably operable for either a DOD ink jet causing a quantity of ink held in the ink delivery channel to be ejected through the ink ejecting bore, or a CIJ serving to break up the jet stream of ink into a synchronous array of drops and to deflect the ink stream; and wherein the nozzle array structure is formed of a plurality of layers formed using thin film transistor technology to establish transistor current drivers forming a drive circuitry and the nozzle array structure has a plurality of ink ejecting bores formed therethrough and each actuating element is a heater element located proximate each ink ejecting bore and is electrically connected to a respective transistor current driver.

32. The ink jet printhead of claim 31 and wherein vias are formed in the nozzle array structure that are connected to respective transistor current drivers.

33. An ink jet print head comprising:

a non-silicon substrate having a front surface and at least partially defining an ink delivery channel, the substrate being of page wide extent;

a nozzle array structure disposed on the front surface of the substrate, the nozzle array defining at least one ink ejecting bore communicating with the ink delivery channel, the nozzle array including a corresponding actuating element for each ink ejecting bore controllably operable for either a DOD ink jet causing a quantity of ink held in the ink delivery channel to be ejected through the ink ejecting bore or a CIJ serving to break up the jet stream of ink into a synchronous array of drops and to deflect the ink stream, and a drive circuitry formed of a discrete integrated circuit chip; and wherein the nozzle array structure has a plurality of ink ejecting bores formed therethrough and the discrete integrated circuit chip is embedded in the surface beneath the first surface of the substrate, the chip including logic circuitry for controlling current for driving a corresponding actuating element for each ink ejecting bore.

34. The ink jet printhead of claim 33 and wherein each actuating element is a heater element formed proximate to each ink ejecting bore.

35. An ink jet print head comprising:

a substrate of a material selected from the group consisting of metal, glass, ceramic and plastic material;

a nozzle array structure disposed on a front surface of said substrate, the nozzle array structure being composed of at least one layer of a semiconducting or non-conducting material;

at least one ink holding chamber defined by the substrate and the nozzle array structure;

a plurality of ink ejecting nozzles extending through the nozzle array structure to the at least one ink delivery channel; and the nozzle array structure including a plurality of actuating elements associated with the plurality of ink ejecting bores, respectively, each of the actuating elements being controllably operable for either DOD ink jet operation causing a quantity of ink in the ink delivery channel to be ejected through an associated ink ejecting bore or a CIJ operation serving to break up a jet stream of ink into a synchronous array of droplets and to deflect the stream, and a plurality of drive circuits including TFTs and conductive paths connecting the TFTs or IC chips to the actuating elements, respectively; and wherein the nozzle array structure is formed of a plurality of layers formed using thin film transistor technology to establish transistor current drivers and each actuating element is a heater element located proximate a respective ink ejecting nozzle and is electrically connected to a respective transistor current driver.

36. An ink jet print head comprising:

a substrate of a material selected from the group consisting of metal, glass, ceramic and plastic material;

a nozzle array structure disposed on a front surface of said substrate, the nozzle array structure being composed of at least one layer of a semiconducting or non-conducting material;

at least one ink holding chamber defined by the substrate and the nozzle array structure;

a plurality of ink ejecting nozzles extending through the nozzle array structure to the at least one ink delivery channel;

the nozzle array structure including a plurality of actuating elements associated with the plurality of ink ejecting bores, respectively, each of the actuating elements being controllably operable for either DOD ink jet operation causing a quantity of ink in the ink delivery channel to be ejected through an associated ink ejecting bore or a CIJ operation serving to break up a jet stream of ink into a synchronous array of droplets and to deflect the stream, and a plurality of drive circuits including a discrete IC chip and conductive paths connecting the IC chip to the actuating elements, respectively; and wherein the discrete integrated circuit chip is embedded in the surface beneath the first surface of the substrate, the chip including logic circuitry for controlling current for driving plural actuating elements each associated with a respective one of plural ink ejecting nozzles.

37. The ink jet printhead of claim 36 and wherein each actuating element is a heater element located proximate each ink ejecting nozzle.

* * * * *